United States Patent [19]

Reid

[11] 4,031,725

[45] June 28, 1977

[54] DOOR LOCK

[76] Inventor: Floyd F. Reid, 603 W. Rochelle, No. 1073, Irving, Tex. 75062

[22] Filed: Aug. 11, 1975

[21] Appl. No.: 603,618

[52] U.S. Cl. ..... 70/107; 70/111; 70/482; 292/169.13

[51] Int. Cl.[2] ..... E05B 59/00; E05C 1/12

[58] Field of Search ..... 70/107, 111, 146 P, 70/151; 292/169.13

[56] References Cited

UNITED STATES PATENTS

| | | | |
|---|---|---|---|
| 2,709,911 | 6/1955 | Russell | 70/147 |
| 3,159,993 | 12/1964 | Crepinsek | 70/107 |

*Primary Examiner*—Robert L. Wolfe

*Attorney, Agent, or Firm*—H. Mathews Garland

[57] ABSTRACT

A dead bolt type door lock including a combined dead bolt member and latch which engages a common locking recess in a door jamb around a door in which the lock is mounted. The door lock utilizes a standard keyed lock assembly in combination with a latch fitted in sliding relationship within a channel shaped dead bolt member so that when the dead bolt member is retracted into the door the latch functions in a conventional manner and when the dead bolt is extended over the latch into the door jamb opening the door is secured against the normal techniques of unauthorized entry commonly accomplished by the use of credit cards and the like. The lock includes linkage and latch assemblies for manipulating and holding the latch and dead bolt sleeve at the various operating positions at which the lock is locked and released. The dead bolt sleeve is selectively operable from both the interior and exterior sides of the door.

7 Claims, 13 Drawing Figures

DOOR LOCK

This invention relates to door locks and more particularly relates to a door lock of the dead bolt type.

The most commonly used type door lock uses a spring and lever operated latch only. This type latch may be readily depressed into the door by the use of such means as a credit card in the hands of a skilled intruder. In veiw of the fact that unauthorized entry has become commonplace throughout the country increased efforts are being made to discourage unauthorized entry by the use of various types of locks including frequently the use of a separate dead bolt which extends a substantial distance into the door jamb an is manipulated in such a maner that is cannot be depressed by a card inserted between the door edge and the jamb. While such dead bolt arrangements are effective against unauthorized entry, they do involve substantial additonal expense and require separate installation an openings in both the door and the door jamb since they most often are independent of the conventional latch arrangement. A combination dead bolt and latch has been proposed by prior art patents though such a system has not come into common usage in view of the complexity and cost of the designs which have been proposed.

It is an especially important object of the present invention to provide a door lock wherein dead bolt and latch functions an mechanism are combined to permit the use of single openings in both the door and the door jamb.

It is another object of the present invention to provide a door lock which utilizes a latch nested within a dead bolt member whereby the latch and dead bolt member are insertable into the same door jamb locking recess.

It is another object of the present invention to provide a door lock having a sleeve type dead bolt fitted around the latch of the lock and operable from both sides of the door.

It is another object of the present invention to provide a combination latch and dead bolt assembly usable with a conventional keyed lock.

In accordance with the present invention a door lock is provided which employs a latch and dead bolt assembly wherein the latch is movable within a channel shaped dead bolt sleeve permitting housing the complete locking mechanism of the door lock in a single opening in a door and insertion of both the latch and dead bolt member into a single opening in the latch plate and door jamb. The door lock includes a thumb operated lever between the outside knob an door plate to permit the dead bolt sleeve to be extended from the outside position. The dead bolt sleeve can be retracted from either side of the door when the door is unlocked and from only the normal inside of the door when the door is locked. The operating assembly of the lock includes a lever arrangement for extending the dead bolt assembly to a locking position from the normal outside or keyed lock side of the door independently of the doorknob shaft through the door which extends the dead bolt sleeve when the interior doorknob is rotated.

The foregoing objects and advantages of the invention together with specific details thereof will be better understood from the following detailed description taken in conjunction with the accompanying drawings wherein.

Figure 1:
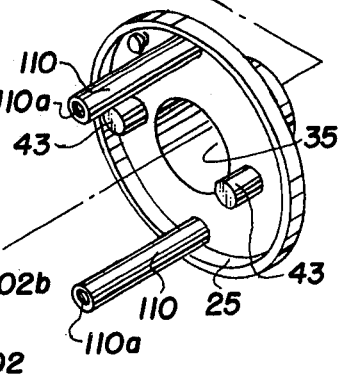
FIG. 1 is an exploded view in perspective of a preferred form of a complete door lock embodying the features of the invention.
Figure 1:
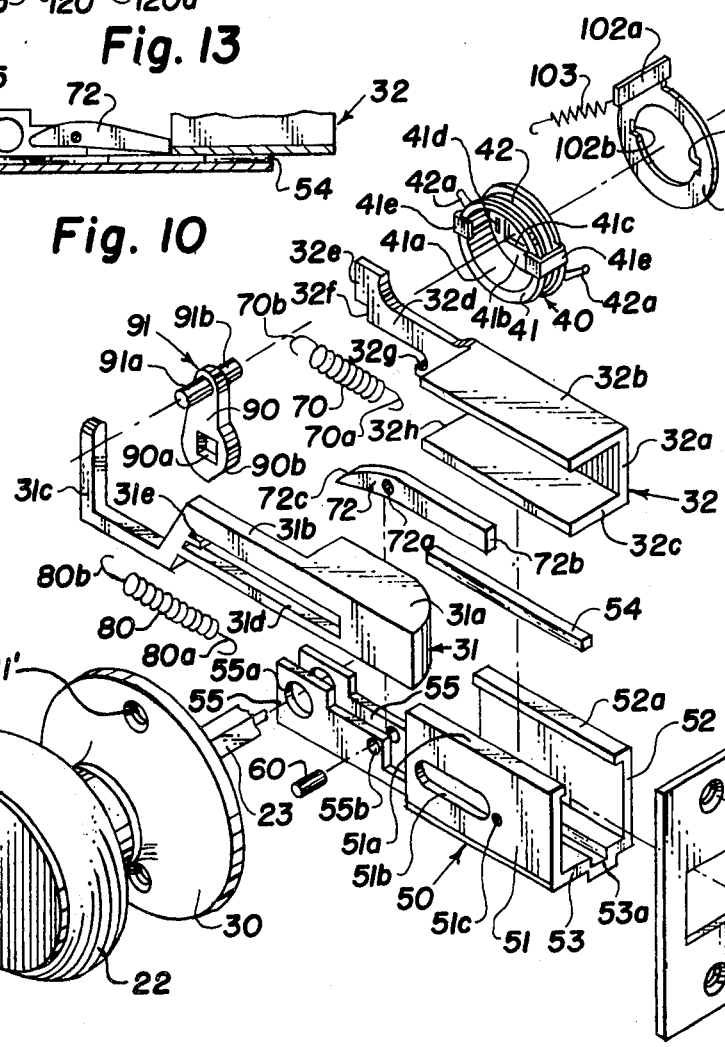

Referring to FIG. 1 of the drawings, a lock assembly 20 embodying the features of the invention includes exterior and interior doorknob assemblies 21 and 22 together with an operating shaft 23 and a lock operating rod 24 of a conventional commercially available keyed lock. A currently available lock which is operable in the invention is a Model No. A 500DL manufactured by Weiser Co., a division of Norris Industries, of South Gate, California. Such lock assembly includes the exterior knob 21 which has a keyed lock for operating the lock assembly and the internal knob 22 which is selectively depressed and rotated slightly clockwise for conventional locking and reverse action for unlocking the door from the inside. The usual exterior plate 25 is provided for supporting the lock assembly on the outside of the door while similarly an interior plate 30 is secured with the interior knob 22 for supporting the lock on the interior face of the door. In accordance with the invention a latch 31 and a dead bolt sleeve 32 are coupled with the interior and exterior knob assemblies for releasably locking a door with a doorjamb. The latch 31 fits in sliding relationship with the dead bolt sleeve 32 so that both the latch and the dead bolt sleeve are extendable from a common opening in the door edge into a single opening in a latching plate mounted in the door frame. The dead bolt sleeve is operable from either side of the door for securely locking the door from both the inside and outside.

The exterior knob 21 is mounted on a sleeve 33 having diametrically opposed end tabs 34. The mounting sleeve 33 for the exterior knob 21 fits through a flanged opening 35 in the exterior mounting plate 25. The plate 25 secures on the outside face of a door for suppporting the exterior knob and related structure. The hollow square shaft 23 is positioned along the center line of the mounting shaft 33 and coupled internally with the knob 21 which comprises a portion of the standard lock previously indentified. The shaft 23 extends through the entire lock assembly to the inside face of the door through the interior mounting plate 30 into the interior knob 22. Thus rotation of either the exterior or interior knobs turns the shaft 23. The lock operating rod 24 extends from the keyed lock assembly in the exterior knob 21 into the latching assembly in the interior knob 22. Operation of the keyed lock in the exterior knob actuates the rods 24 which manipulates the interior knob to move the interior knob between released and locking positions. The exterior knob with the keyed lock, the hollow square shaft 23 along with the lock operating rod 24, the interior and exterior plates 25 and 30 and the interior knob 22 are all conventional parts of the previously referred to and identified standard lock assembly Model No. A500DL. In such assembly the lock is latched to lock the door preventing retraction by the exterior knob of the latch 31 by depressing the interior knob 22 towards the inside face of the door and rotating the knob to the usual locked position. The lock may be released by rotation of the interior knob in the opposite direction which releases the interior knob thereby releasing the latch 31 for retraction. Similarly, the lock is latched by depression of the interior knob and shutting the door when passing out through the door to leave it locked. By inserting the proper key into the lock in the exterior knob 21 the keyed lock is released to operate the rod 24 which unlatches the interior knob 22 so that access may be had through the door from the outside.

The mounting sleeve 33 of the outside knob 21 extends through the opening 35 in the outside plate 25 to the inside of the plate where the end tabs 34 engage a spring assembly 40 mounted on the square shaft 23 at the inside face of the plate 25 for biasing the interior and exterior knobs to a central neutral position of rotation. The spring assembly 40, a part of previously referred to Weiser Lock Model No. A 500DL, is formed by a frame 41 and a spring 42. The frame 41 has a cylindrical body portion 41*a* and an end plate 41*b* which is provided with a square opening 41*c* and spaced rectangular openings 41*d*. The spring 42 is a coil spring wrapped around the cylindrical body portion of the frame and held in place by strap members 41*e* made integral with the frame. The spring 42 has opposite end portions 42*a* which engage internal pins 43 on the inside face of the plate 25. Rotation of either of the knobs in either direction causes the spring 42 to be coiled more tightly by virtue of the engagements of the end portions of the spring with the pins 43 so that the knob rotation is resisted by the spring. When either of the knobs is released the spring assemly 40 returns the knobs an shaft 23 to a central neutral position.

The latch 31 and the dead bolt sleeve 32 are slidably supported within a channel shaped frame 50. The dead bolt sleeve fits within the frame and the latch slides within the dead bolt sleeve. The frame 50 has side guide panels 51 and 52 which have top edge retainer flanges 51*a* and 52 *a* respectively. The guide panel 51 also has a horizontal spring slot 51*b* and a spring end retainer hole 51*c*. The frame 50 additionally has a bottom portion 53 provided with a central longitudinal guide channel 53*a* which receives a magnet 54 used for manipulating the locking pawl of the dead bolt sleeve as discussed in more detail hereinafter. The frame 50 has lateraly spaced vertical end flanges 55 which have holes 55*a* through which the shaft 23 passes and holes 55*b* for a bearing pin 60 which supports a locking pawl hereinafter described for releasably locking the dead bolt sleeve 32 at an extended locked position. The outside end of the frame 50 along the end edges of the side and end panels 51, 52, and 53 fit along the inside face of a latch plate 61 which has a square opening 62 for extension and retraction of both the dead bolt sleeve 32 and the latch 31. The latch plate is recessed flush with the edge of a door adjacent to the doorjamb in which the lock assembly is mounted. The latch plate is secured with the door edge by screws, not shown, extending through the holes 63 in the latch plate.

Figure 13:
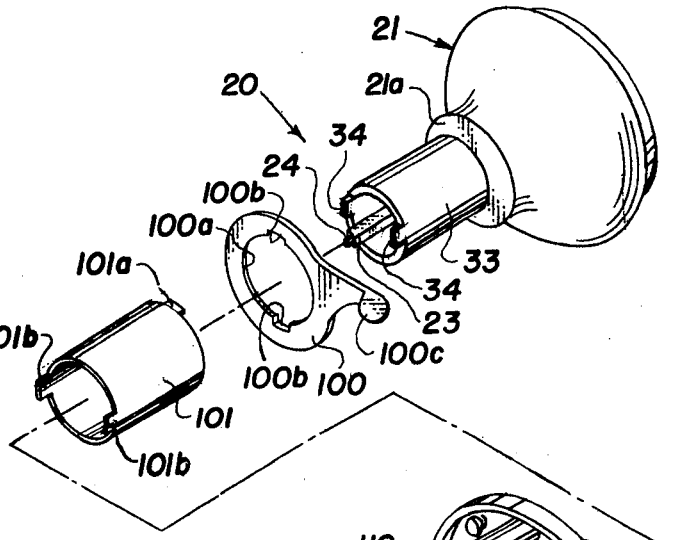
FIG. 13 is a fragmentary side view in section and elevation showing the parts arrangement of FIGS. 11 and 12 including the dead bolt sleeve extended to a locking position and the locking pawl for the sleeve spring biased clockwise to lock the sleeve in the extended position.
Figure 13:
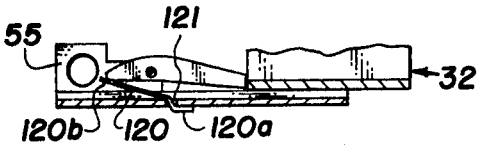
Figure 10:
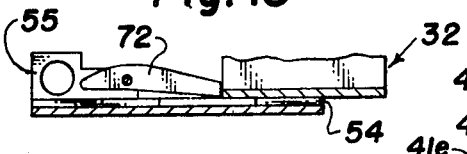
FIG. 10 is a fragmentary side view in elevation showing a portion of the supporting frame for the latch and dead bolt sleeve, the locking pawl for the dead bolt sleeve, and a portion of the dead bolt sleeve extended at locking position of the form of the lock assembly shown in FIGS. 1-8.
Figure 6:
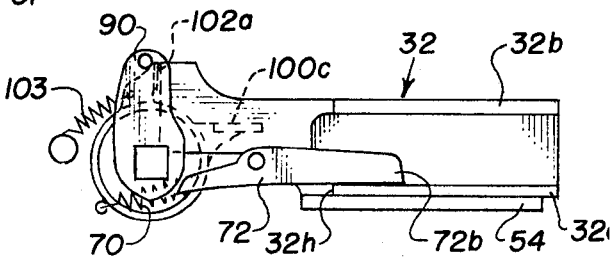
FIG. 6 is a side view in elevation showing the dead bolt sleeve, the locking pawl for the sleeve, the latch magnet for the pawl, the exterior operating lever for the sleeve, and the interior sleeve and latch operating lever, showing the dead bolt sleeve in the retracted position.
Figure 9:
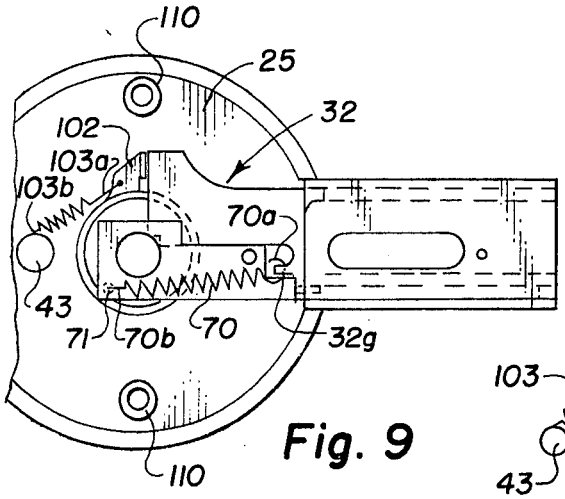
FIG. 9 is a side view in elevation showing the exterior doorplate, the supporting frame for the latch and dead bolt sleeve, and the dead bolt sleeve retracted with the latch removed to show the connection of the spring employed to retract the dead bolt sleeve.
Figure 7:
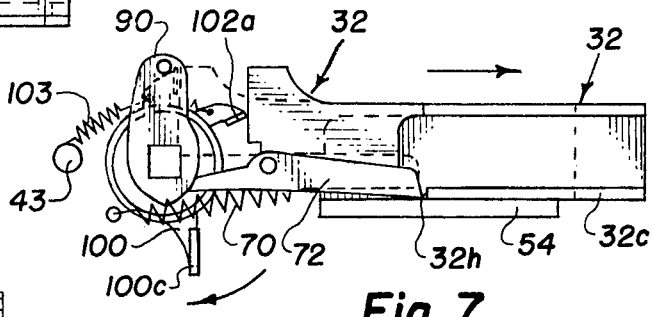
FIG. 7 is a side view in elevation of the assembly of parts shown in FIG. 6 illustrating the movement of the exterior lever for extending the sleeve and showing the dead bolt sleeve in the extended locking position.
Figure 12:
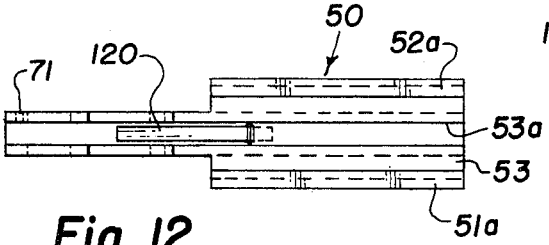
FIG. 12 is a top view of the assembly of parts shown in FIG. 11.

The dead bolt sleeve 32 has a side panel portion 32*a*, a top portion 32*b*, and a bottom portion 32*c*. The panel portions 32*a*, *b*, and *c* form a channel shape which opens at one side of the dead bolt sleeve. The dead bolt sleeve has an inward end portion 32*d* which is a plate extension having an end face 32*e*, a cut out or recess portion 32*f*, and a small foot extension or tab portion 32*g* along the back and below the main body portion of the plate section 32*d*. The dead bolt sleeve 32 fits in sliding relationship inside of the frame 50 being retained in position by the flanges 51*a* and 52*a* of the frame so that the dead bolt sleeve is extendable and retractable from the frame through the latch plate opening 62 for insertion and withdrawal from a doorjamb lock opening recess. As particularly evidend in FIG. 2, the back plate portion 32*d* of the dead bolt sleeve slides behind the back flange portion 55 of the frame 50. The dead bolt sleeve is biased inwardly in a direction away from the latch plate 62 by a spring 70. One end 70*a* of the spring engages a small aperture in the dead bolt sleeve foot portion 32*g*, while the other end 70*b* of the spring 70 engages a hole 71 in the back flange 55 of the frame 50 as best seen in FIGS. 9 and 12. The spring 70 biases the dead bolt sleeve to the retracted unlocked position. When the dead bolt sleeve is extended at the locked position it is held in place against the force of the spring 70 by a locking pawl 72 which is pivotally supported between the frame flanges 55 on the pin 60 which extends through a hole 72*a* in the pawl. As shown in FIGS. 7, 10, and 13 the pawl 72 is rotatable about the pin 60 to a locking position at which the end edge 72*b* of the pawl engages the inward end edge of the lower or bottom section 32*c* of the dead bolt sleeve 32. In the pawl arrangement represented in FIGS. 1, 6–8, and 10 the end 72*b* of the pawl is held downwardly in the locking position by the attraction of the magnet 54 which fits within the channel 52*a* below the lower face of the dead bolt sleeve bottom panel 32*c*. The manner of extending the dead bolt sleeve to the locking position against the spring force of the spring 70 will be described hereinafter.

Figure 2:
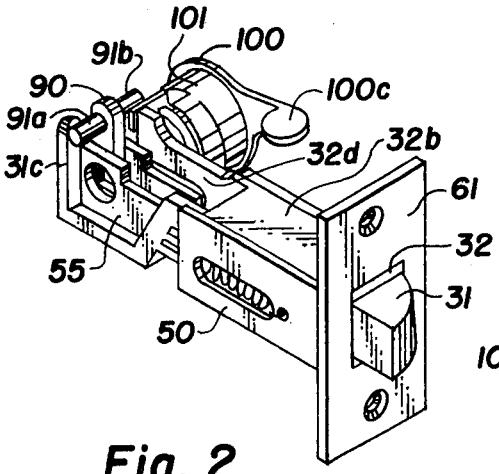
FIG. 2 is a view in perspective of a sub-assembly of the door lock showing only the latch and dead bolt arrangement with the doorknobs and connecting shaft removed.
Figure 4:
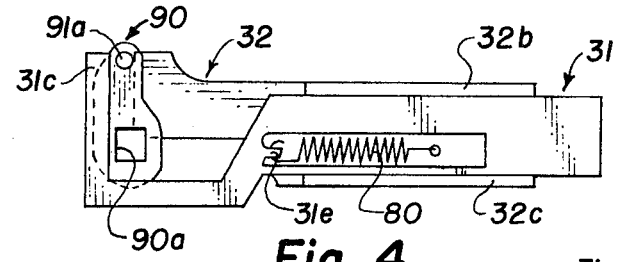
FIG. 4 is a side view in elevation showing only the dead bolt sleeve, the latch nested within the sleeve, and the operating lever for extending the sleeve and retracting the latch from the inside of the door, illustrating the latch extended to locking position.
Figure 5:
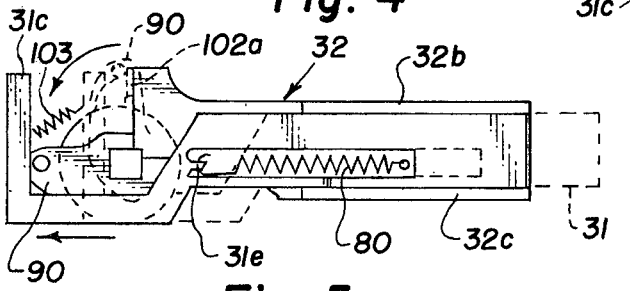
FIG. 5 is a side view in elevation of the sub-assembly of the lock shown in FIG. 4 illustrating the latch retracted in solid lines and the latch in the locking position in broken lines.

The latch 31 slides within the internal channel portion of the dead bolt sleeve 32 as best represented by the relationship of the parts shown in FIG. 1 and as illustrated in FIG. 2. Such relationship is also shown in FIGS. 4 and 5. The latch 31 has a tapered or arcuate locking end portion 31*a*, a central portion 31*b*, and a vetical operating arm 31*c* along the back end portion of the latch. The central portion 31*b* of the latch has a horizontal elongated slot 31*d* into which extends integral apertured tab or flange 31*e*. The locking portion 31*a* of the latch slides within the channel portion of the dead bolt sleeve 31 while the central and back portions of the latch are disposed in front of the frame flange 55 toward the inside doorknob 22 as evident in FIG. 2. The latch 31 is biased outwardly through the opening 62 of the latchplate toward a locking extending position by a spring 80 having one end portion 80*a* connected in the frame hole 51*c* in the frame panel 51 and another end portion 80*b* connected in the latch apertured tab 31*e*. The spring force tending to contract the spring pulls the spring ends together forcing the latch portion 31*e* toward the aperture 51*c* so that the latch locking end portion 31*a* is extended through the latch plate opening 62 from the retracted position within the dead bolt sleeve 32 to a locking position within the locking recess opening of a doorjamb.

The dead bolt sleeve 32 is normally biased by the spring 70 to the retracted unlocked position and may be extended and from both the inside and outside of the door in which the lock assembly 20 is mounted. The latch 31 is normally biased outwardly to the locking position by the spring 80 and is retractable to an unlocked position by either the outside or the inside doorknobs 21 and 22 respectively. An operating lever 90 having a square opening 90*a* is mounted on the the square shaft 23 which extends through the opening 90*a*. The lever 90 is positioned on the shaft 23 between the flanges 55 on the frame 50 as evident in FIG. 2. The lever 90 is provided with an operating pin 91 having one end 91*a* which retracts the latch 31 and another end 91*b* which extends and locks the dead bolt sleeve 32. As viewed in FIG. 1, counterclockwise rotation of the knob 22 rotates the lever 90 counterclockwise so that the pin end 91*a* engages the arm portion 31*c* of the latch retracting the latch against the force of the spring 80. Clockwise rotation of the knob 22 turns the lever 90 clockwise so that the action of the pin end portion 91*b* will force the dead bolt sleeve 32 as viewed in FIG. 1 to the right to an extended locking position through the latch plate opening 62. The finger 90 has a lower cam surface 90*b* which is engageable with the end portion 72*c* of the locking pawl 72 to release the locking pawl for unlocking or releasing the dead bolt sleeve 32 upon counterclockwise rotation of the lever 90 by the knob 22 as viewed in FIG. 1. This same action, of course, occurs with the rotation of the outside knob 21 when the door lock is not locked.

The dead bolt sleeve 32 is extendable to a locking position from the outside of the door at the knob 21 by a lever 100, an operating sleeve 101, and an operating ring 102 which has an operating plate portion 102*a* engageable with the end face of the dead bolt sleeve portion 32*e*. The operating lever 100 has an opening 100*a* which fits over the mounting sleeve 33 of the outside doorknob 21. The lever 100 has diametrically opposed inwardly opening recesses 100*b* which receive end tabs 101*a* on the operator sleeve 101. The lever 100 fits over the sleeve 33 against the shoulder 21*a* of the outside doorknob while the operator sleeve 101 telescopes over the sleeve 33 with the tabs 101*a* engaged in the recesses 100*b* of the lever 100. The sleeve 101 extends through the opening 35 in the plate 25 to the inside of the plate where end tabs 101on the sleeve 101 engage operating recesses 102*b* of the operator ring 102 inside the door within the outside plate 25. The operator ring 102 is biased in a counterclockwise direction as viewed in FIG. 1 by a spring 103 which connects between the operator ring and the adjacent pin 43 on the inside face of the plate 25. This is best seen in FIG. 9 which shows one end portion 103*a* of the spring secured into a small aperture of the ring 102 and another end portion 103*b* of the spring wrapped around the pin 43 on the inside face of the plate 25. Thus the operator lever 100 is on the outside of the door between the plate 25 and the knob 21 and may be rotated clockwise as viewed in FIG. 1 to drive the sleeve 101 clockwise turning the operator ring 102 clockwise forcing the flange 102*a* against the end face of the dead bolt sleeve 32 to force the dead bolt sleeve outwardly to the locked position. The operator lever 100 has a finger tab 100*c* for convenience in the engaging a door operator's thumb with the operator lever. The spring 103 biases the operator ring 102 in a counterclockwise direction away from the end edge of the dead bolt sleeve to hold the operator ring 102 and the lever 100 in an inoperative position except when positively rotated to lock the dead bolt sleeve. The operator ring plate 102*a* is positioned between the end edge 32*e* of the dead bolt sleeve and the operating pin 91*b* on the lever 90 so that the ring 102 may function to extend the dead bolt sleeve to the locking position independently of the lower 90 and additionally the lever 90 may be rotated to move the plate member 102*a* toward the dead bolt sleeve end edge when the dead bolt sleeve is to be operated by lever such as from inside of the door by the knob 22.

The door lock 20 is assembled with a door in the usual manner used with conventional door locks utilizing the same cavities or space within the door and the same locking recesses and the like in the doorjamb around the door. The inside plate 30 fits along the inside face of the door while the outside plate 25 fits in a corresponding position on the outside face of the door. The mounting posts 110 secured with the inside face of the outside plate 25 extend through the door and are connected with the inside plate 30 by screws, not shown, which are threaded through holes 111 in the inside plate 30 into the internally threaded open ends 110*a* of the mounting posts 110 thereby holding the door lock securely with the door through the opening provided in the door. This manner of securing the door lock with the door is conventional and is used with all available locks of the type, identical or similar to the previously identified Model No. A 500DL.

With the door lock 20 installed on a door the latch 31 and the dead bolt sleeve 32 are each operable from either inside or outside of the door. The coaction of the spring unit 40 with the pins 43 on the inside face of the outside plate 25 biases the shaft 23 and the outside and inside doorknobs 21 and 22 to a neutral position to which they are returned during normal operation of the door each time the doorknob being turned by the hand of an operator is released such as when passing through the door at times when the door is not locked. At such times the normal position of the latch 31 is extended as shown in FIG. 2 at which the door is considered latched though it is not necessarily locked, in the sense that rotation of either the outside or inside knobs when the door is unlocked will retract the latch 31 for openging the door. The latch 31 is held at this extended latch position by the spring 80 extending in a stretch relationship between the tab 31*e* of the latch and the hole 51*c* in the frame 50 which pulls the latch toward the right as seen in FIGS. 1, 4, and 5. Similarly, the normal position of the dead bolt sleeve 32 is retracted as shown in FIG. 2. The sleeve is held at the retracted position by the spring 70 engaged between the tab 32*g* on the sleeve and the hole 71 in the frame 50 as best seen in FIG. 9.

Figure 3:
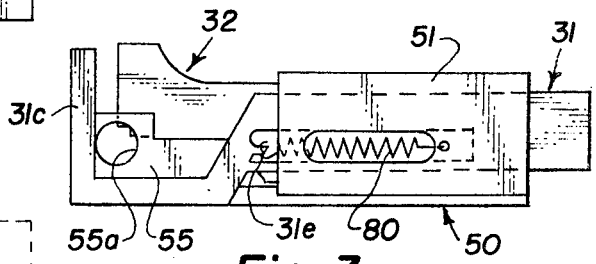
FIG. 3 is a side view in elevation of a sub-assembly of the door lock including only the latch, the dead bolt sleeve, and the supporting frame for the latch and the sleeve, showing the latch extended to a locking position.

The door lock is operable from the inside doorknob 22 for both retracting the latch 31 to release the door for opening and for setting the dead bolt sleeve 32 at the extended locked position and locking the door as represented particularly in FIG. 7. As previously stated, the latch 31 is held normally extended in the locking position by the spring 80. The doorknob 22 is turned counterclockwise as viewed in FIG. 1 to retract the latch 31 to the release position. Counterclockwise rotation of the doorknob turns the square rod 23 counterclockwise rotating the lever 90 in a counterclockwise direction so that the pin 91 moves toward the left as seen in FIGS. 1 and 5. The pin portion 91*a* engages the vertical arm portion 31*c* along the back of the latch 31 retracting the latch toward the left until the lever 90 has been rotated counterclockwise approximately 90° at which position the latch is fully retracted as shown in FIG. 5. In this unlatch position it will be apparent that the door may be opened. When the doorknob is released the spring assembly 40 rotates the shaft 23 along with the inside and outside doorknobs back in a clockwise direction as viewed in FIG. 1 returning the shaft and doorknob to a neutral position at which the lever 90 is moved back to the vertical position permitting the spring 80 to contract to return the latch 31 to the extended locked position represented in FIGS. 2, 3, and 4.

When the dead bolt sleeve 32 is to be extended to the locking position as represented in FIG. 7, the inside knob 22 is turned clockwise as viewed in FIG. 1 rotating the lever 90 clockwise rotating the pin 91*b* in a downward arc. The pin 91*b* engages the operator ring plate portion 102*a* which in turn bears against the inside end edge 32*e* of the dead bolt sleeve. This relationship between the pen 91*b*, the plate 102*a*, and the vertical end edge 32*e* of the dead bolt sleeve is shown clearly in FIG. 6. The clockwise rotation of the lever 90 by the knob 22 thus forces the dead bolt sleeve 32 toward the right extending the dead bolt through the latch plate opening 62 into a locking recess of the doorjamb, not shown. It will be noted in FIG. 6 that the locking pawl 72 is biased in a clockwise direction so that the end of the pawl to the right of the pivot pin 60 as identified by the end edge 72*b* on the pawl rests on the top surfaces of the plate 32*c* of the dead bolt sleeve. When the doorknob is rotated sufficiently to turn the lever 90 approximately 90 degrees the dead bolt sleeve is extended to the right to a position at which the inside end edge 32*h* has moved beyond the pawl end edge 72*b* so that the pawl snaps downwardly to the position shown in FIG. 7 behind and in a locking relationship with the dead bolt sleeve edge 32*h* so that the dead bolt is held at the extended locked position by the pawl 72 as represented in FIG. 7. The pull of magnet bar 54 on the locking pawl holds the pawl downwardly at such locked position to retain the dead bolt sleeve extended and locked. The end face 72*b* of the pawl slopes approximately 3° from vertical toward the left as seen in FIG. 1. The angular relationship of the end face 72*b* with the sleeve edge 32*h* thus tends to provide a wedging relationship between the pawl and the dead bolt sleeve assisting in holding the sleeve at the locked position. The extension and locking of the dead bolt sleeve provides a perceptible "clicking" sound which will be evident to the door operator so that the operator knows that the sleeve has been extended and locked by the pawl. The doorknob may be released and it will be returned by the spring system 40 to the neutral position leaving the dead bolt sleeve extended and locked and returning the lever 90 to a vertical position. This does not, however, preclude entry from outside the door by rotation of the knob 21 which would retract the dead bolt sleeve and thus, it is necessary to fully lock the door from the inside with the dead bolt sleeve extended by depressing knob 22 and turning it to the right until it stops turning in order to activate the key lock in the usual manner. The knob 22 will, of course, be depressed slightly inwardly and will remain in such a locked position until it is either rotated to unlock and release the knob from the inside or until the keyed lock in the outside knob 21 is operated. With the knob 11 rotated to the right, depressed, and locked the dead bolt sleeve 32 is at the extended locking position, thereby precluding unauthorized entry through the door.

Figure 8:
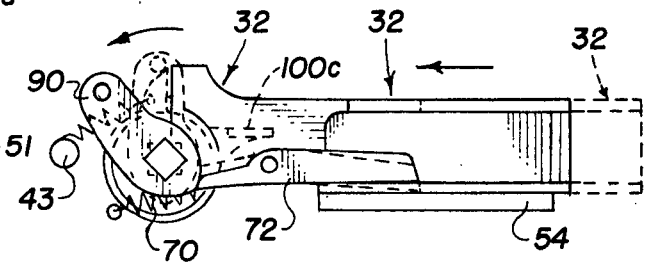
FIG. 8 is a side view in elevation similar to FIGS. 6 and 7 showing the dead bolt sleeve and sleeve locking pawl returned to the positions of FIG. 6 and the latch operating lever rotated to a position for releasing the sleeve locking pawl.

When opening the door from the inside with the knob 22 from the just described locked relationship, the knob 22 is turned counterclockwise which releases the conventional keyed lock allowing the knob 22 to extend sightly inwardly away from the inside face of the door so that the knob is again operative and coupled with the square shaft 23 so that the shaft 23 is rotatable in a counterclockwise direction by turning the knob 22 counterclockwise. Prior to the counterclockwise rotation of the knob 22, the dead bolt sleeve is extended and locked as in FIG. 7. As the knob 22 is roatated counterclockwise, however, the lever 90 is turned counterclockwise causing the lower cam surface 90*b* on the lever 90 to move upwardly and to the right along the cam surface 72*c* on the top of the inside end of the locking pawl 72 which is holding the dead bolt sleeve extended and locked. This cam action of the lever 90 against the locking pawl 72 as represented in FIG. 8, forces the locking pawl to rotate on the pin 60 also in a counterclockwise direction lifting the end edge 72*b* of the locking pawl upwardly disengaging the locking edge from the inside end edge 32*h* on the dead bolt sleeve. When the locking pawl end edge 72*b* moves above the end edge surface 32*h* of the dead bolt sleeve, the dead bolt sleeve is released permitting the spring 70 to retract the dead bolt sleeve back into the door to an unlocked position. Of course it will be evident that with this counterclockwise rotation of the lever 90, releasing the dead bolt sleeve, there also is the action of the pin portion 91*a* on the lever 90 which retracts the latch 31 by engagement with the operating arm 31*c* on the latch so that the latch 31 is retracted by the lever 90 and the spring 70 retracts the dead bolt sleeve, fully unlocking the door from the inside. For reasons which will be evident in the description of the operation of the door lock 20 when going through the door to the outside to leave it locked, the extension and locking of the dead bolt sleeve 32 with the inside knob 22 involves rotation of the knob a slight degree farther clockwise as seen in FIG. 1, than it is necessary to turn the kno when depressing the knob for locking the door with the keyed lock from the inside. Thus, the arrangement of the mechanism of the present invention in relationship to the standard keyed lock used is such that the keyed lock is operated from the inside by depressing the knob 22 and rotating it to stop position which is somewhat short of the extended rotation necessary to extend and lock the dead bolt sleeve 32. This permits the dead bolt sleeve to be fully activated from the inside and the keyed lock thereafter locked by depression and roatation of the knob 22.

In passing through the door from the inside to the outside and in order to leave the door locked with the dead bolt sleeve 32 extended and locked, it is necessary in accordance with the features of the invention that the keyed lock be activated from the inside, that the door then be closed, and that the dead bolt sleeve 32 be actuated from outside the door. It will be apparent that this is the only manner in which the door lock can function since the door cannot swing when the dead bolt sleeve is extended and thus the sleeve cannot be extended prior to passing through the door to the outside and shutting the door. As previously explained, the latch 31 is held at the extended locking position of FIG. 2 by the spring 80 as distinguished from the use of any wedging member or force for holding the latch extended and locked. Thus, even when the keyed lock of the door lock is locked, the latch 31 can be depressed into the door to the unlocked position, and it is for this reason that dead bolts are desirable as standard type door latches are readily depressed by the insertion of credit cards and the like. Thus in passing through the door from the inside to the outside and with the objective of leaving the door locked with the dead bolt sleeve, the keyed lock is activated by depressing the knob 22 and rotating it to the stop position at which the keyed lock is locked. It will be recalled that this stop position is short of the rotation necessary by the knob to extend and lock the dead bolt sleeve. Thus with the knob 22 locked from the inside and the dead bolt sleeve still in the retracted unlocked position, the door is closed by simply swinging it to the closed position. As the door swings closed, the latch 31 is cammed inwardly sufficiently to allow the door to close and the latch will then snap back outwardly to the locked position since the spring 80 is the only force acting on the latch at this time. With the door now closed and the keyed lock activated by the inside knob 22, the outside knob 21 cannot be rotated. When the door operator grasps the outside knob 21 to close the door, the thumb will be positioned against the thumb lever 100. Rotating lever 100 by the operator's thumb in a clockwise direction as viewed in FIG. 1 which, from the outside of the door facing door, would be in a counterclockwise direction. Turning the lever 100 turns the sleeve 101 which extends through the opening 35 of the outside plate 25 to the internal operator ring 102. The ring 102 is turned in a clockwise direction as seen in FIG. 1 forcing the plate portion 102*a* on the ring 102 downwardly and toward the right along the back inside edge 32*e* of the dead bolt sleeve. The dead bolt sleeve is forced toward the right extending the sleeve through the opening 62 of the latch plate 61. The beginning position of the parts involved may be seen in FIG. 6 while the extended locked position and the position of the various operating parts is seen in FIG. 7. The lever 100 is turned until a stop is reached at which the dead bolt sleeve 32 is fully extended and locked by the dropping of the locking pawl 72 in behind the edge 32*h* of the dead bolt sleeve as also represented in FIG. 7. The lever 100 is then released with the spring 103 rotating the operator ring 102, the sleeve 101 and the lever 100 back counterclockwise to the positions evident from FIGS. 6 and 7 at which the plate 102*a* of the ring 102 is returned back to the vertical position. Thus the keyed lock is fully acitivated so that the doorknob 21 from outside the door cannot be turned and the dead bolt sleeve 32 is extended and locked by means of the operator lever 100. While the lever 100 is used to move the dead bolt sleeve 32 to the locked position from the outside of the door, the lever 100 cannot be used to unlock the dead bolt sleeve from the outside. Since the keyed lock is locked, the doorknobs and the shaft 23 are locked against rotation from the outside and thereby any effort to turn the lever 100 in the counterclockwise position beyond the point shown in FIG. 6 is opposed by the locked lever 90, thereby precluding the release of the deadbolt sleeve 32 by counterclockwise turning of the operator lever 100 against the lever 90.

When entry through the locked door from the outside is desired the key is inserted in the outside knob 21, turning the rod 24 which rotates the inside knob 22 to release the keyed lock allowing the knob to be free for rotation. With release of the keyed lock the outside knob 21 is rotated in a counterclockwise direction as viewed in FIG. 1, turning the square shaft 23 which rotates the lever 90 counterclockwise so that the cam surface 90*b* on the lever 90 engages the pawl cam surface 72*c* turning the pawl 72 counterclockwise releasing the deal bolt sleeve. The spring 70 retracts the dead bolt sleeve while the rotation of the lever 90 also forces the pin portion 91*a* against the arm 31*c* of the latch 31, retracting the latch fully unlocking the door.

Figure 11:
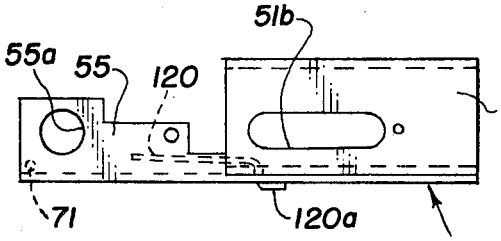
FIG. 11 is a side view in elevation of the supporting frame for the latch and dead bolt sleeve and an alternate form of operating member comprising a spring for the dead bolt sleeve locking pawl.

The door lock 20 has been described in the terms of the use of the magnet 54 for applying a clokwise force to the locking pawl 72 for locking the dead bolt sleeve 32 at the extended locked position of FIG. 7. Alternate means of applying the necessary force to the locking pawl to rotate it to the locked position is represented in FIGS. 11, 12, and 13. A leaf type spring 120 is secured with the frame 50 for applying a clockwise force as seen in FIGS. 1 and 13 to the locking pawl 72 for moving the locking pawl into wedging relationship with the dead bolt sleeve when the sleeve is extended. The spring 120 has a bent end portion 120*a* which extends through an opening 121 in the bottom 53 of the frame 50 in alignment with the channel 53*a*. The spring has a free end portion 120*b* which engages the bottom edge of the pawl 72 below the cam surface 72*c* applying a constant upward force on the pawl tending to rotate the pawl clockwise on the pin 60 as viewed in FIGS. 1 and 13. FIGS. 11 and 12 show the frame 50 alone with the spring 120 installed. FIG. 12 illustrates the relationship of the spring position with the bottom portion of the frame 50. Either the spring arrangement as shown in FIG. 13 or the magnet arrangement as shown in FIG. 10 may be employed as desired. Either the magnet 54 or the spring 120 will effectively move the locking pawl to the locked position of FIG. 7 when the dead bolt sleeve is extended sufficiently to enable the pawl to move downwardly into the proper locked position.

It will now be understood from the foregoing description and as illustrated in the drawings that a snew and improved door lock has been described and illustrated. The door lock combines the features of a conventional lock with a spring biased latch and a dead bolt while using the same door and doorjamb openings and eliminating the extra expense of the separate hardware and the possibly objectionable look of such hardware on a door to provide a dead bolt function. By combining the structure and function of both a dead bolt system and a conventional keyed lock system, the appearance of a door is improved the cost factor is reduced, and the installation of a dead bolt feature may be accomplished at less expense. The dead bolt is operational from both inside and outside the door with the structure and function of the dead bolt sleeve being interrelated to provide operation which is fully compatible with conventional available keyed locks of the type previously referred to. By controlling the latch, the dead bolt sleeve, and the keyed lock with only the knob 22 on the inside of the door, rapid locking and unlocking of the door is possible in the event that a person wished to quickly pass out through the door. While from outside the door the dead sleeve is set by separate lever, once the keyed lock is released from outside the door, the dead bolt sleeve is also operable by the outside knob.

What is claimed is:

1. A door lock adapted to be mounted on a door and operated by first and second doorknobs mounted on opposite sides of said door comprising: a keyed lock associated with said first and second doorknobs, said first doorknobs being operable to activate said keyed lock by depressing and turning said doorknob and said second doorknob being operable by means of a key; a latch; means for moving said latch between a retracted unlocked position and an extended locked position; a dead bolt sleeve fitting in sliding relationship around said latch for movement between a retracted unlocked position, said latch and said dead bolt sleeve occupying a common recess in a doorjamb adjacent to said door when said latch and said dead bolt sleeve are extended to locked positions; lever means for extending said dead bolt sleeve by rotation of at least said first doorknob, said lever means being mounted on a shaft connected between and rotatable by said first and second doorknobs and being engageable with said latch responsive to rotation of either of said doorknobs in one direction to retract said latch and being engageable with said dead bolt sleeve responsive to rotation of said door knobs in an opposite direction; means for releasably locking said dead bolt sleeve at said extended locked position; means for releasing said dead bolt sleeve for movement from said extended locked position back to said retracted unlocked position by rotation of either of said first and second doorknobs; said lever means including an operator surface engageable with said means for releasing said dead bolt sleeve to release said dead bolt sleeve from said extended locked position by rotation of either of said doorknobs in said direction which retracts said latch; and means for moving said dead bolt sleeve from said first retracted position to said second extended position from the side of said door on which said second doorknob is mounted and independently of said second doorknob.

2. A door lock in accordance with claim 1 wherein said means for extending said dead bolt independently of said second knob comprises an operator assembly engageable with said dead bolt sleeve independently of said lever means.

3. A door lock in accordance with claim 2 wherein said latch is spring biased to an extended locked position and said dead bolt sleeve is spring biased to a retracted unlocked position.

4. A door lock for releasably locking a door with a doorjamb and having a keyed outer doorknob and an inner doorknob adapted to be locked by depressing and turning, said door lock comprising: a shaft extending between said outer doorknob and said inner doorknob through said door; a spring assembly connected with said shaft for biasing said shaft to a neurtal position; a latch adapted to be moved between a retracted unlocked position and an extended locked position; a dead bolt sleeve fitted in sliding relationship around said latch for movement between a retracted unlocked position and an extended locked position; said latch and said dead bolt sleeve being nested together whereby said latch and said dead bolt sleeve are extendable into a common locking recess in a doorjamb adjacent to said door; a supporting frame securing said latch and said dead bolt sleeve together in operating relationship for movement between said retracted unlocked positions and said extended locked positions; a spring secured between said frame and said latch applying a force to said latch for moving said latch to said extended locked position; a spring secured between said frame and said dead bolt sleeve applying a force to said dead bolt sleeve for moving said dead bolt sleeve to said retracted unlocked position; a locking pawl pivotally secured with said frame and movalble between a release position and a lock position at which a locking surface on said pawl engages a locking surface on said dead bolt sleeve when said dead bolt sleeve is at said extended locked position for holding said dead bolt sleeve locked; means for biasing said pawl toward a position at which said pawl holds said dead bolt sleeve at said extended locked position; an operating lever on said shaft between said doorknobs and rotatable by said shaft responsive to rotation of said doorknobs; a first operating surface on said lever for engaging and retracting said latch responsive to rotation of said shaft in a first direction by either of said doorknobs; a second operating surface on said lever for engagement with said dead bolt sleeve for moving said dead bolt sleeve from said retracted unlocked position to said extended locked position responsive to rotation of said shaft in a second direction by either of said doorknobs; a third operating surface on said lever for engaging said pawl to rotate said pawl to a position at which said dead bolt sleeve is released for retraction to said unlocked position responsive to rotation of said shaft by either of said doorknobs in said first direction; and operation lever supported around said shaft between said doorknobs adjacent to said outer doorknob; and operator sleeve secured with said operator lever extending toward said inner doorknob; an operator ring connected with said operator sleeve; an operator plate surface on said operator ring engageable with said dead bolt sleeve for moving said dead bolt sleeve independently of said second operator surface on said lever to extend said operator sleeve to said locked position responsive to rotation of said operator lever in said second direction for extending said dead bolt sleeve to said locked position independently of said outer doorknob from the outside side of said door; and a spring secured with said operator ring to return said operator ring, said operator sleeve, and said operator lever in said first direction to a neutral position after extendng and locking said dead bolt sleeve.

5. A door lock in accordance with claim 4 wherein said means for biasing said pawl to a locking position with said dead bolt sleeve comprises a magnet.

6. A door lock in accordance with claim 4 wherein said means for biasing said pawl to a position for locking said dead bolt sleeve comprises a spring connected with said frame.

7. A door lock in accordance with claim 4 wherein said frame includes a first pair of vertical spaced side panels for supporting said latch and dead bolt sleeve in sliding nested relationship with each other, and said frame includes a second spaced vertical panels for supporting said pawl.

* * * * *